United States Patent [19]

Ores

[11] 4,384,602

[45] May 24, 1983

[54] INFLATED CARRYING APPARATUS

[76] Inventor: Pauline A. Ores, 9 Murray St, 9 Fl., New York, N.Y. 10007

[21] Appl. No.: 269,673

[22] Filed: Jun. 2, 1981

[51] Int. Cl.[3] ..... B65D 30/00

[52] U.S. Cl. ..... 150/1; 150/12; 220/94 R

[58] Field of Search ..... 224/264; 150/0.5, 1, 150/12; 46/87, 88

[56] References Cited

U.S. PATENT DOCUMENTS

| | | | |
|---|---|---|---|
| 2,672,963 | 3/1954 | Epton | 190/57 |
| 3,462,069 | 8/1969 | Suominen | 229/54 R |
| 3,482,761 | 12/1969 | Suominen et al. | 229/55 R |
| 3,500,973 | 3/1970 | Bush | 190/57 |
| 3,665,551 | 5/1972 | Ender | 16/110 |
| 3,753,824 | 8/1973 | Bosse | 166/227 |
| 3,818,962 | 6/1974 | Muller-Scherak | 150/1 |
| 3,883,053 | 5/1975 | Pritchard et al. | 224/264 |

FOREIGN PATENT DOCUMENTS

| | | | |
|---|---|---|---|
| 219874 | 8/1924 | United Kingdom | 224/264 |

*Primary Examiner*—Steven M. Pollard
*Assistant Examiner*—D. Voorhees
*Attorney, Agent, or Firm*—Fleit, Jacobson & Cohn

[57] ABSTRACT

A flexible material apparatus for carrying an article retained by an article receiving means, comprising a carrying member adapted for attachment to the article receiving means and having a hollow tube of flexible airtight material being partially pneumatically inflated to provide a pliant carrying member. One embodiment includes the article receiving means comprising a receptacle, such as a bag, having hermetically sealed and pneumatically inflatable bottom and end panels. The carrying member includes a flexible material handle attached to the end panels having fluid communication with the panels so that partial pneumatic inflation of the handle and panels is permitted, whereby carrying an article in the bag causes air to be displaced from one or more of the panels to cause the handle to become turgid. In another embodiment, a pair of handles is attached to the side panels, which are also hermetically sealed to provide fluid communication between each panel and handle. The handle may be U-shaped, and the bag and/or handle may be pneumatically inflated to 75% capacity. Other embodiments include the article receiving means comprising a cord for retaining an article, and the handle adapted for attachment thereto. In another embodiment, the receptacle comprises a backpack, and the carrying member comprises an inflated shoulder strap.

8 Claims, 9 Drawing Figures

FIG. 1
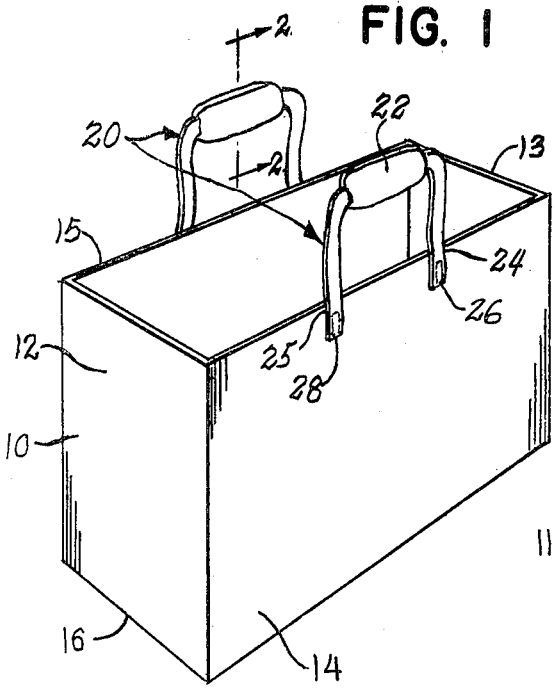
FIG. 2
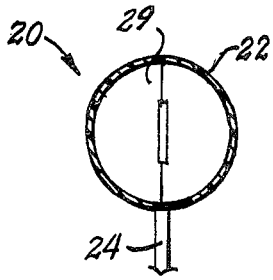
FIG. 3
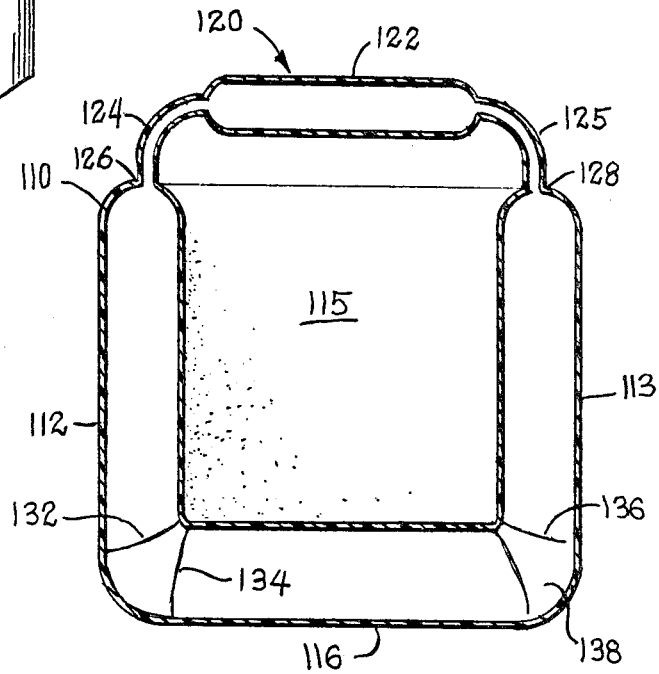
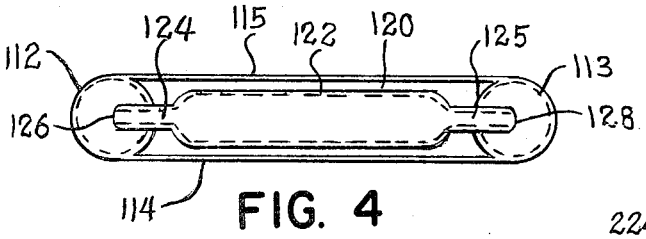
FIG. 4
FIG. 5
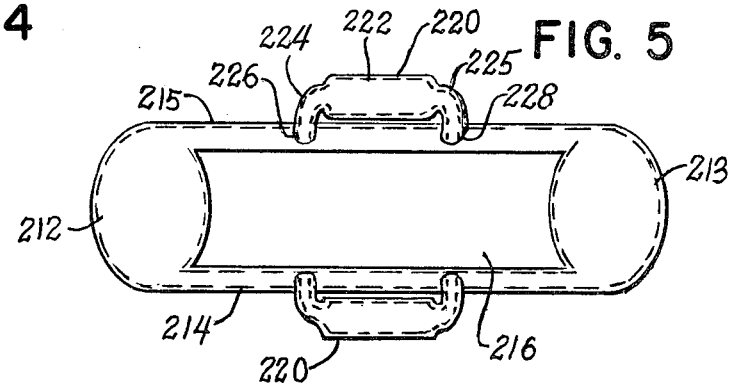

INFLATED CARRYING APPARATUS

BACKGROUND OF THE INVENTION

1. Field of the Invention

This invention relates to carrying members including handles and straps of flexible material, either alone or in combination with an article receiving means. In particular, it relates to inflated flexible material handles and straps, and to inflated flexible material receptacles having inflated carrying members attached thereto.

2. Description of the Prior Art

Conventional carrying members include handles and straps which may be flexible, or may be of a rigid construction. With the flexible type, the handles are often cut from flat material, typically in a U-shape, and attached to an article receiving means. The article receiving means may range from a typical carrying receptacle, including carrying bags and backpacks, to a cord of string or twine retaining the article. When a heavy load is placed within the receptacle, the handles have a tendency to tear along the inside corner portions since there is a lack of reinforcing material. This is especially a problem when the handles are made of a flexible plastics material, such as polyethelene. On the other hand, while rigid construction type carrying handles are sturdier in terms of withstanding heavier loads, they often include complicated reinforced structures which are expensive to manufacture due to increased material requirements and more complex structural interconnections.

Aside from the above-mentioned problems of increased manufacturing costs and lack of durability, such conventional carrying handles and straps are often times uncomfortable to the person carrying a load, especially when the load to be carried is increased. For example, in the case where a flexible type material is used for a handle, the weight of a heavy load tends to cause the flat flexible material handle to cut into one's hand similar to a rope, which can be very uncomfortable, and even painful when carrying a heavy load for an extended period of time. Similarly, when a strap is used to carry the load, such as a shoulder strap, the same shortcomings are present.

By the same token, handles and straps having a rigid construction do not always properly conform to the shape of the load bearing surface of the anatomy, e.g., the hand or shoulder of the person carrying the receptacle. In addition, rigid handles and straps are not capable of providing a pliant surface which is readily adaptable to the user's anatomy in order to provide a carrying surface which is softer and more comfortable to use.

Typical article receiving means, such as conventional flexible material carrying receptacles, including bags and backpacks, do not readily retain their shape, and do not provide an opening for conveniently receiving the load to be carried in the receptacle. In addition, when an article is placed in a conventional carrying receptacle, such as a bag, it may have a tendency to become lodged or positioned within the bag in a position not near the center of the bottom of the bag. When this happens, since the weight of the article is not evenly distributed throughout the bag, the load is supported at only one end of the U-shaped handle where it is attached to the bag, rather than at both ends. Consequently, the end of the handle carrying the bulk of the weight will tend to tear away from its attachment to the carrying bag, since the weight is not evenly distributed to the handle or handles. Likewise, with a pair of straps on a backpack, an off-center load will exert more force on one strap than the other, causing it to tend to tear away. Also, when the load is off-center within the receptacle, it is more cumbersome and awkward for a person to carry. If the receptacle is a bag, it tends to swing outward or into the person's body as the bag is being carried, and if a backpack, it causes imbalance.

Finally, conventional flexible material carrying receptacles do not provide a sturdy yet convenient carrying receptacles, nor do they offer any protection or cushioning of the articles to be carried in the receptacle.

SUMMARY OF THE INVENTION

It is an object of the present invention to construct an improved flexible material structure for a carrying handle and for a carrying strap which is simple and efficient to manufacture.

It is a further object of the present invention to construct flexible material handles and straps which are pliant and adaptable to conform to the anatomy of the person carrying the load.

It is another object of the present invention to construct a flexible material carrying bag having handles which are convenient to use, yet offer improved comfort and durability.

It is another object of the present invention to construct a flexible material backpack having straps which are convenient to use, yet offer improved comfort and durability.

It is another object of the present invention to construct a flexible material carrying member which is strong and able to adequately support the load carried in the receptacle without causing discomfort to the load bearing part of the body of the person utilizing the carrying member.

It is another object of the present invention to construct a flexible material carrying receptacle having carrying members which retains its shape and permits articles to be readily placed into an open top portion of the receptacle.

It is yet another object of the present invention to provide a flexible material carrying receptacle construction which efficiently and evenly distributes the weight, of articles carried in the receptacle, to the carrying member.

Another object of the present invention is to construct a flexible material carrying receptacle in which articles carried in the bag tend to become centered and held in the receptacle for better distribution of the load, as well as convenience in carrying the receptacle.

Further objects of the present invention will become apparent in the full description of the invention taken in conjunction with the drawings set forth below.

The flexible material carrying member comprises a hollow tube of flexible airtight material adapted to be attached to an article receiving means to facilitate carrying a load. A pneumatically inflatable chamber is provided within the tube. The hollow chamber is partially pneumatically inflated to provide a pliant carrying member for carrying the load received in the article receiving means. The carrying member in the form of a handle may be U-shaped, and may be inflated to approximately 75% of its capacity. Another embodiment of the invention includes a pneumatically inflatable hollow tubular handle being attached to an article receiving means comprising a receptacle in the form of a flexible carrier bag having pneumatically inflatable panels. The inflatable handle is attached so as to provide fluid communication between the handle and the inflatable bag panels. The bag and handle are then partially inflated. Carrying a load placed in the bag causes air to be displaced from the inflated bag panel into the hollow tube handle, thereby causing the handle to become turgid. Another embodiment includes a pneumatically inflated shoulder strap attached to a backpack, which may also be pneumatically inflated.

BRIEF DESCRIPTION OF THE DRAWINGS

FIG. 1 is a perspective view of a preferred embodiment of an improved carrying member of flexible material for a flexible carrier receptacle in accordance with the present invention.

FIG. 2 is a sectional view along line 2—2 of the handle shown in FIG. 1.

FIG. 3 is a diagrammatic sectional view of an embodiment of a flexible material carrying bag and handle apparatus in accordance with the present invention.

FIG. 4 is a diagrammatic top view of the embodiment shown in FIG. 3.

FIG. 5 is a diagrammatic top view of an alternative embodiment of a flexible material carrying bag and handle apparatus in accordance with the present invention.

DETAILED DESCRIPTION OF THE DRAWINGS

Figure 6:
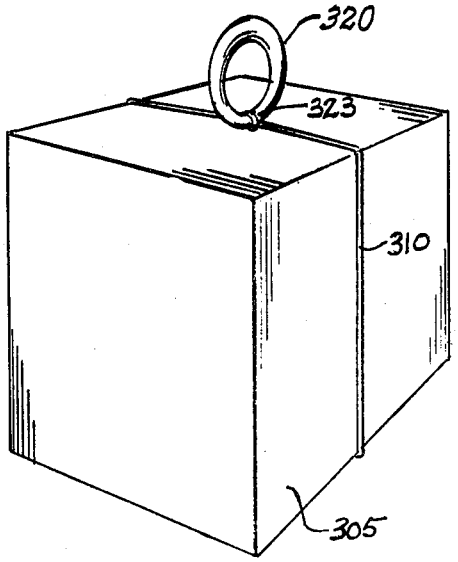
FIG. 6 is a diagrammatic perspective view of a preferred embodiment of an improved handle of flexible material.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring to the drawings, in FIGS. 1 and 2 there is shown an article receiving means 10 being a receptacle, in the form of a bag, having a pair of carrying members 20, such as handles. The bag 10 has a bottom panel 16, side panels 14, 15, and a pair of end panels 12, 13. Handle 20 includes a hollow flexible tube portion 22 having solid end portions 24, 25, which are adapted to be securely attached to the bag such as at side panels 14, 15, as shown at connecting portions 26, 28; such as by stitching, heat pressing, adhesive, or other suitable method. The hollow tube section 22 is made of airtight material enabling it to be pneumatically inflatable. It is pneumatically inflated with a suitable fluid, such as air, and the fluid is hermetically sealed inside chamber 29 within hollow tube 22 to provide a pliant yet sturdy and turgid inflated handle for the bag. The hollow tubular handle is made of a flexible material being pneumatically inflatable, and providing an airtight seal. One preferred material is a flexible plastics material such as polyethelene, which is simple and efficient to manufacture and use, while providing adequate strength and durability for the inflated handle. Vinyl and vinyl coated fabric are examples of other flexible materials which may also be utilized.

FIGS. 3 and 4 illustrate an embodiment of the present invention in the form of a flexible material carrying bag and apparatus which includes end panels 112, 113 and bottom panel 116 being hollow and pneumatically inflatable. In this embodiment, side panels 114, 115 are not pneumatically inflatable, and comprise a flat surface. An important feature of this embodiment is that the handle 120, which is pneumatically inflatable, is hermetically sealed to the bag at the end portions 126, 128 of the handle in a manner to provide fluid communication via channels 124, 125 with the pneumatically inflatable end panels 112, 113 and bottom panel 116.

The invention also preferably includes the use of creases or seams 132, 134, 136, and 138 in the flexible material at the juncture of the end panels 112, 113 with the bottom panel 116, to maintain corner shaping where the panels meet and provide improved wear characteristics.

It is desirable that the material from which the bag is made be the same material as that from which the handle is manufactured so as to allow manufacturing the bag and handle apparatus in one step. However, another desirable embodiment utilizes two types of flexible material, the type of material used for the handle having more flexibility than the type of material used for the bag portion. This embodiment accommodates the carrying of a heavier load. Since the more rigid material in the panels is less flexible, more of the air in the bottom and sides is displaced to the more flexible handle, so as to make the handle proportionately more turgid as the load is increased.

The panels and handle then are partially pneumatically inflated. By "partially pneumatically inflated", it is meant that the inflatable portions of the bag are inflated to a volume in an amount which is at least half of the volume capacity of the flexible panels when they are in a totally extended state. One preferred embodiment is where the panels and handle are inflated to approximately 75% of total volume capacity. The effect of being partially inflated is that when heavy objects are placed in the bag the end panels and handle(s) become turgid due to the air being forced from the partially inflated bottom panel of the bag into the end panels and handle. This results in better weight distribution of the load when an article is carried in the bag, and realizes many of the aforementioned objectives of the invention. Also, the handle is made more turgid to take into account the added weight of the load in the bag.

Another embodiment having two handles is shown in FIG. 5. Each of the pair of handles 220 has a hollow flexible tubular portion 222 and end conduit portions 224, 225 at both ends thereof attached to side panels 214, 215 at connecting portions 226, 228. Side panels 214, 215 are inflatable and are hermetically joined with an inflatable bottom panel 216, and with inflatable end panels 212, 213. The panels and handles are then partially inflated and then hermetically sealed as a unit, with the air free to move between the panels and handles. In this embodiment, the fluid communication between the panels and each handle is provided via the side panels rather than the end panels as in the previous embodiment. This embodiment having a pair of handles attached to the side panels permits the bag to be opened wide to place large and bulky items therein. In addition, since all panels are partially inflated, it provides more cushioning and protection for the article, and tends to securely hold the article or articles in place when the bag is being carried.

While the embodiments shown contemplate the side or end panels being completely inflatable to provide fluid communication between the bottom panel and handle for simplicity and ease of manufacture, it should be realized that the invention includes providing any suitable method of providing fluid communication between the partially inflated bottom panel and handle, such as by tubes, channels or conduits incorporated in the side or end panels.

As shown in the drawings, FIGS. 3, 4 and 5, the front and back side panels are thinner than the end panels. This accounts for ease of placing articles in the bag. It also permits the front and back panels to not be inflated if so desired, as in FIGS. 3 and 4, as long as the air in the bottom panel is permitted to flow back and forth between the inflatable panels and the handle to make the handle turgid when carrying a load.

Figure 7:
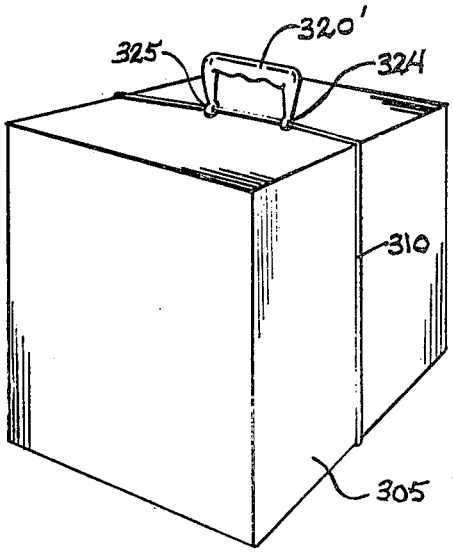
FIG. 7 is a diagrammatic perspective view of a preferred embodiment of an improved handle of flexible material.

While the handle has been described as being attached to a receptacle in the form of a hand-carry type bag, the pneumatically inflatable concept for carrying an article receiving means bearing a load to provide a comfortable load carrying surface is not so limited. FIGS. 6 and 7 illustrate an alternative embodiment in which the handle is adapted to carry larger boxes. In FIG. 6 there is shown a pneumatically inflated handle 320 for carrying a box 305. Handle 320 is adapted to be transversely attached at handle portion 323 to article receiving means 310 in the form of a cord of twine, string, wire or other suitable line wrapped securely and tied about box 305. The cord may simply be attached to the cord by being looped about the handle, as shown at 323, or any suitable attachment apparatus may be employed, such as a loop, hook, or opening in the inflated handle. The embodiment of FIG. 7 is similar to that of FIG. 6, except that the handle 320' is adapted to be longitudinally attached at handle portions 324, 325, shown as openings in the handle, to article receiving means 310. The inflated handle may be made of a suitable airtight material such as vinyl coated fabric.

Figure 8:
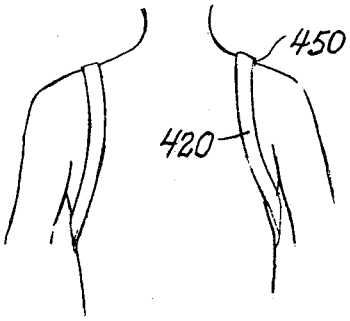
FIG. 8 is a diagrammatic front view of a preferred embodiment of an improved shoulder strap of flexible material for a backpack in accordance with the present invention.
Figure 9:
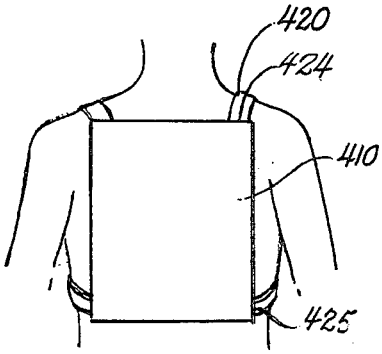
FIG. 9 is a diagrammatic back view of the embodiment shown in FIG. 8.

FIGS. 8 and 9 show another preferred embodiment in which the article receiving means is a receptacle in the form of a backpack 410 and the pneumatically inflated carrying member is in the form of a shoulder strap 420 across the shoulder 450 of a person carrying a load. The strap is adapted to be attached to the backpack at strap portions 424, 425. The description of the inflatable bag panels would apply to the backpack, and the straps may be constructed to provide fluid communication with the backpack. Suitable materials for the inflated shoulder strap include vinyl coated fabric.

Although the present invention has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts. Thus, it should be noted that the accompanying description and drawings are meant to describe the preferred embodiments of the invention, but are not intended to limit the spirit and scope thereof.

What is claimed is:

1. A flexible material apparatus for carrying an article, comprising:

a pneumatically inflatable receptacle;

a carrying member having a pneumatically inflatable hollow tube of flexible material, and having an end attached to said receptacle;

said carrying member and said receptacle being hermetically sealed together and partially pneumatically inflated; and means for providing fluid communication between said carrying member and said partially pneumatically inflated receptacle, whereby carrying an article in said receptacle causes air to be displaced from said partially pneumatically inflated receptacle into said carrying member for causing said carrying member to become turgid.

2. The apparatus of claim 1, wherein said carrying member is made of a first material and said receptacle is made of a second material, said first material having greater flexibility than said second material.

3. The apparatus of claim 1, wherein said carrying member and said receptacle are pneumatically inflated to approximately 75% of volumetric capacity.

4. The apparatus of claim 1, wherein said carrying member comprises a strap and said receptacle comprises a backpack.

5. The apparatus of claim 1, wherein said carrying member comprises a handle.

6. The apparatus of claim 5, wherein said partially pneumatically inflated receptacle comprises a bag having:

a partially pneumatically inflated bottom panel;

an end panel connected to said bottom panel; and a side panel connected to said bottom panel and to said end panel.

7. The apparatus of claim 6, wherein said fluid communication means includes said end panel being hermetically sealed and pneumatically inflatable to provide fluid communication between said handle and said partially pneumatically inflated bottom panel, and wherein said handle is attached to said end panel.

8. The apparatus of claim 6, wherein said fluid communication means includes said side panels being hermetically sealed and pneumatically inflatable to provide fluid communication between said handle and said partially pneumatically inflated bottom panel, and wherein said handle is attached to said side panel.

* * * * *